United States Patent [19]

Muller et al.

[11] Patent Number: 4,871,330

[45] Date of Patent: Oct. 3, 1989

[54] ELECTRICAL CONNECTOR CONSTRUCTION

[75] Inventors: Manfred Muller; Lutz Biederstedt, both of Berlin, Fed. Rep. of Germany

[73] Assignee: Krone Aktiengesellschaft, Fed. Rep. of Germany

[21] Appl. No.: 191,553

[22] Filed: May 9, 1988

[30] Foreign Application Priority Data

May 8, 1987 [DE] Fed. Rep. of Germany ..... 3715876

[51] Int. Cl.[4] ..... H01R 9/22

[52] U.S. Cl. ..... 439/709; 439/620

[58] Field of Search ..... 439/59, 61, 62, 389, 439/391, 395, 620, 709, 719, 723, 267; 361/119

[56] References Cited

U.S. PATENT DOCUMENTS 4,741,711 5/1988 Singer, Jr. ..... 439/620

4,776,803 10/1988 Pretchel et al. ..... 439/59

FOREIGN PATENT DOCUMENTS 2078450 1/1982 United Kingdom ..... 439/391

*Primary Examiner*—Eugene F. Desmond

*Attorney, Agent, or Firm*—McGlew & Tuttle

[57] ABSTRACT

A connecting strip or receiver has switch contacts formed between break contact flaps which are arranged at a distance or spacing from each other, two interconnecting housing parts define a plug-in channel for a switch or a test plug which makes an electrical connection.

The break contact flaps are positioned at a defined distance between them by housing inner walls which also define a plug-in conneciton channel.

4 Claims, 1 Drawing Sheet

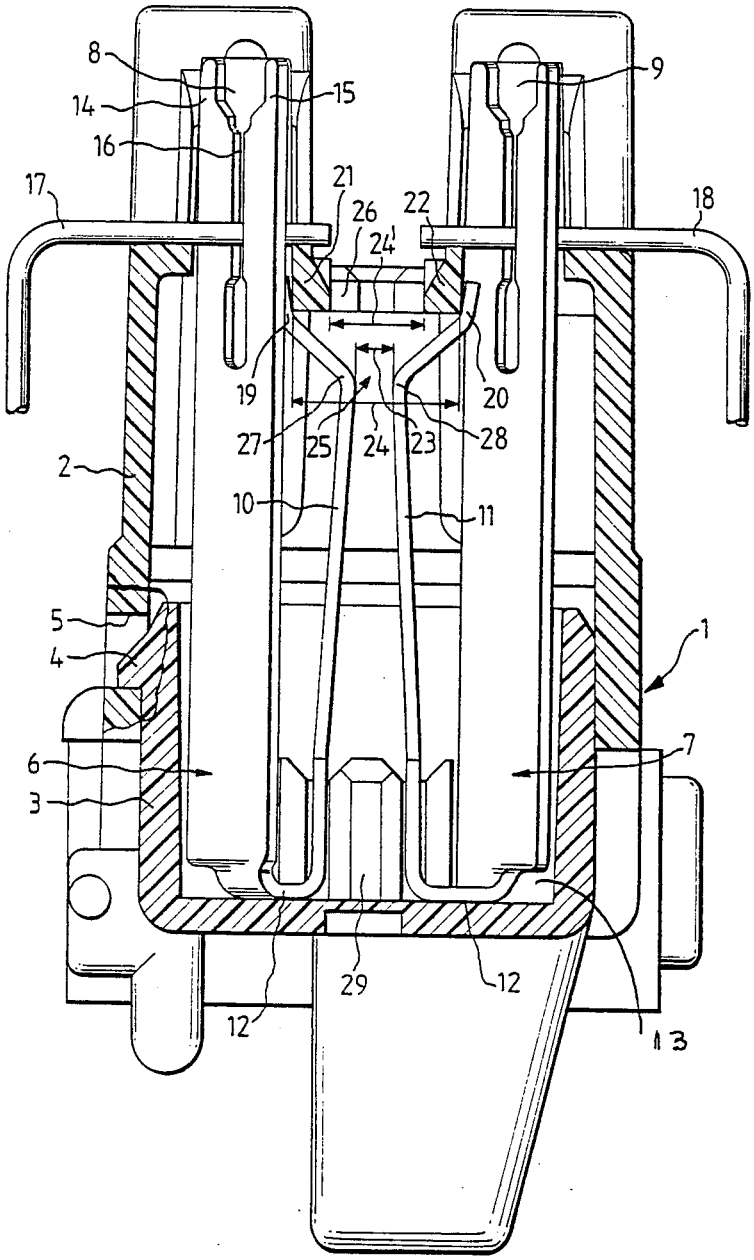
8
14
16
15
9
17
21
26
22
18
24
19
20
27
25
24
23
28
2
10
11
5
4
1
6
7
3
29
12
12
13

ELECTRICAL CONNECTOR CONSTRUCTION

BACKGROUND OF THE INVENTION

FIELD OF THE INVENTION

This invention relates in general to electrical connectors, and in particular to a new and useful method and apparatus for effecting an electrical clamping and connection of particularly communication wires in particular and to establishing a break contact flap facing such connectors.

A connecting strip similar to the invention is previously known from German Patent DE-OS No. 35 25 568. Here, the distance between break contact flaps of a connection element pair is formed by a separating rod of an insulating material, which rests on a lower transverse rib of the casing of the connecting strip. The use of a separating rod for generating the distance between the break contact flaps of the connecting element pair has, however, the disadvantage that the distance between the break contact flaps is a function of the factory size of the separating rod and the the distance between break contact flaps is a function of the factory size of the separating rod and the size break contact flaps, as well as of the size of the transverse rib serving as a contact surface for the separating rod. Since the separating rod rests on the transverse rib formed at the floor of the casing of the connecting strip, the distance between the break contact flaps depends also on their lengths.

Lastly, all connecting element pairs must be exactly alike and set into the connecting strip extremely precisely in order to obtain for all connecting element pairs the desired defined distance of the break contact flaps from each other.

Maintaining precisely the distance between the break contact flaps is required, according to VDE guide lines, since the insulation resistance specified hereby is not ensured if the distance is too small, and, since at too great a distance no reliable contact of a switch plug, in particular a test plug, plugged in between the break contact flaps is possible.

SUMMARY OF THE INVENTION

The invention, therefore, is based on the task of creating a connecting strip with switch contacts, in which the distance between the break contact flaps is set with maximum precision without additional structural elements, with as few as possible of the factory sizes affecting the distance between the break contact flaps of the switch contacts.

In accordance with the invention, the extensions of the break contact flaps rest resiliently on the inner walls of the casing of the connecting strip so as to find a precise distance between them. This defined distance can be obtained without additional structural elements and depends only on the factory sizes of the outer and inner surfaces of the inner walls. The inner walls which delimit the plug-in channel, so that all pairs of break contact flaps built into the connecting strip receive a defined distance from each other.

Accordingly, it is an object of the invention to provide an improved method of establishing a facing between two opposed biasing contact flaps off of an electrical connector which comprises defining fixed positions for tube operating wire connecting clamping and contact elements which are connectable to two respective insulated wire elements and providing a spacing for break contact flaps associated with each connecting and clamping elements which have inwardly extending biasing portions which are held at fixed space relationships to each other by surfaces which are defined in a housing of the device.

A further object of the invention is to provide an improved electrical connector which includes a housing which forms recesses for holding spaced apart cutting and clamping contacts each of which has a break contact flap which extends in an intermediate portion toward the other which includes a wall surface which holds the clamps so that they are at a predetermined spacing from one another in an area which defines a plug in channel.

A further object of the invention is to provide an electrical connector which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only FIGURE of the drawings is a transfer sectional view of an electrical connector constructed in accordance with the invention.

DESCRIPTION OF THE PREFERRED EMBODIMENTS

Referring to the drawings in particular the invention embodied therein comprises an electrical connector having a connector housing or insulated mounting generally designated 1 made up of inter-engaged upper part 2 and lower part 3 which together define receiving recesses for connecting elements or combined cutting and clamping elements 6 and 7 in a spaced relationship with a plug-in channel 26 being defined therebetween. In accordance with the invention, the break contact flap 10 and 11 for each respective connecting element 6 and 7 includes intermediate portions or angle bends 27 and 28 which extend toward the other and are held in a defined spaced relationship by inner walls or surfaces 21 and 22 of the housing so as to define precise spaced locations for these elements at a location of a plug-in channel 26 which receives a switch contact or testing plug at the location 25.

A plastic casing of a connecting strip or receiver 1 comprises an upper part 2 and a lower part 3, which are connected through catch hooks 4 of the lower part 3, which lock into openings 5 of the upper part 2. Into the lower part 3, U-shaped connecting elements 6 and 7 of electrically conducting elastic metal material are set. One leg of each U-shaped connecting element 6 and 7 has a cutting-clamping contact 8 and 9 and, on each other leg, a break contact flap 10 and 11 is formed. The underside 12 of each connecting element 10 and 11 rests on the inner floor surface 13 of the lower part 3 on both sides of a transverse rib 29 extending upwardly from the floor surface. Each cutting/clamping contact 8 and 9 has two legs 14 and 15, between which a clamping slit 16 is formed. When an insulated cable core 17 and 18 is pressed into the clamping slit 16, the insulation of the cable core 17 and 18 is cut by the sharp edges of the clamping slit 16 and an electrical contact between a conductor in the cable cores 17 and 18 and the connecting element 6 and 7 is formed.

In accordance with the invention resilient break contact flaps 10 and 11 have angle bends 27 and 28 forming a switch or plug contact 25, and extensions 19 and 20 thereof extend in the upward direction toward the free end and rest resiliently on the outer surfaces of respective upper inner walls 21 and 22 of the upper part 2 of the connecting strip 1. The inner walls 21 and 22 thus define a plug-in channel 25 extending toward the bottom and formed in the longitudinal axis of the connecting strip 1 for a (not shown) switch plug, and particularly for a test plug. In each plane of a pair of connecting elements 6 and 7 two break contact flaps 10 and 11 oppose each other. The angle bends of 27 and 28 of the contact flaps lo and 11 are directed against each other. Between them a defined minimum distance or spring distance 23 exists, which is determined by the distance or spacing 24 of the outer surfaces of the two inner walls 21 and 22. Into the plug-in channel 26 a switch and/or a test plug can be plugged into the connecting strip 1 between the break contact flaps 10 and 11. In the process, the break contact flaps 10 and 11 rest on the outer surfaces of the inner walls 21 and 22 under spring prestress. When a test plug is placed into the channel between the two break contact flaps 10 and 11 they cause the flaps to spring toward the outside corresponding to the width of the test plug which enlarges the spacing 23 between the break contact flaps 1 and 11. The electrical contact between test plug and the break contact flaps 10 and 11 in contact on both sides takes place by the biasing of the stamped angle bends 27 and 28 formed on the break contact flaps 10 and 11. Upon the test plug being pulled out, the two break contact flaps 10 and 11 spring toward each other and, consequently, decrease the distance between the angle bends or indentations 27 and 28. The extensions 19 and 20 rest under spring prestress on the outer surfaces of the respective inner walls 21 and 22 with the minimum distance 23 having been reached again. This permits maintaining the insulation resistance specified by the VDE guide lines in each case.

In a second model (not shown) the extensions of the break contact flaps can also lie against the inner surfaces of the inner walls with the break contact flaps, the break contact flaps, however, need to be under spring prestress directed toward the outside. Upon inserting the test plug, no flying back of the break contact flaps can take place so that greater contact pressure can be exerted. In this model, the break contact flaps, even after the plug has been pulled out, remain in an essentially unchanged position.

The connecting strip according to the invention serves to connect cable cores in telecommunications technology.

While a specific embodiment of the invention has been shown and described in detail to illustrate the application of the principles of the invention, it will be understood that the invention may be embodied otherwise without departing from such principles.

What is claimed is:

1. A connecting strip comprising:

a housing defining spaced-apart electrical cutting/-clamping element receiving channels and including wall portions intermediate said cutting/clamping receiving channels defining an electrical connecting plug-in channel;

a plurality of cutting/clamping elements, each of said plurality of cutting/clamping elements being positioned in one of said cutting/clamping element receiving channels;

a plurality of break contact flaps, each of said plurality of break contact flaps including a lower portion connected to one of said plurality of cutting/-clamping contacts, an angled bend portion and an extension, each of said angle bend portion extending in a direction toward an associated opposite angle bend portion of an associated opposite break contact flap, each extension resting on a cooperating one of said wall portions to provide a gap between opposite break contact flaps to delimit said electrical connecting plug-in channel.

2. An electrical connector according to claim 1, wherein said housing includes an upper and lower portion which are provided with interengageable hook and recess portions which hold said portions together, said upper housing portion including said wall portions against which said break contact flaps are positioned, said cutting/clamping elements extending through openings of said upper portion of said housing, said openings bounding a surface against which said break contact flaps are positionable.

3. An electrical connector according to claim 2, wherein said cutting/clamping elements each include an axially extending slot for a contact wire having insulation thereon, the slot being defined to engage the contact wire within the insulation to pierce the insulation as the contact wire is moved down in the slot.

4. A connecting strip comprising: a housing defining spaced-apart electrical cutting/clamping element receiving channels with contact openings provided in an upper portion of said housing, said housing including wall portions provided intermediate said contact openings forming an intermediate opening defining an electrical connecting plug-in channel, a plurality of cutting/clamping elements, each of said plurality of cutting/clamping elements being positioned in one of said cutting/clamping element receiving channels with cutting/clamping legs extending through an associated one of said contact openings; a plurality of break contact flaps, each of said plurality of break contact flaps including a lower portion connected to one of said plurality of cutting/clamping contacts, an angle bend portion connected to said lower portion and an extension extending from said angle bend portion, each said angle bend portion extending in a direction toward an associated opposite angle bend portion of an associated opposite break contact flap, said extensions resting on a cooperating one of said wall portions to provide a gap between opposite angle bend portions, said gap being smaller than a width of said intermediate opening.

* * * * *